US010196792B2

(12) United States Patent
Schmand et al.

(10) Patent No.: US 10,196,792 B2
(45) Date of Patent: Feb. 5, 2019

(54) GROUND FREEZING METHOD

(71) Applicants: Ralf Schmand, Unterschleissheim (DE); Abraham Sliwo, Walchwil (CH)

(72) Inventors: Ralf Schmand, Unterschleissheim (DE); Abraham Sliwo, Walchwil (CH)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 15/350,177

(22) Filed: Nov. 14, 2016

(65) Prior Publication Data

US 2017/0138010 A1 May 18, 2017

(30) Foreign Application Priority Data

Nov. 17, 2015 (EP) ..... 15003267

(51) Int. Cl.

| | |
|---|---|
| ***E02D 3/115*** | (2006.01) |
| ***F25D 3/10*** | (2006.01) |
| ***E02D 3/11*** | (2006.01) |
| *F25D 7/00* | (2006.01) |
| *F25D 17/02* | (2006.01) |

(52) U.S. Cl.

CPC ..... *E02D 3/115* (2013.01); *E02D 3/11* (2013.01); *F25D 3/10* (2013.01); *F25D 7/00* (2013.01); *F25D 17/02* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,256,188 | A | 3/1981 | Hopkins et al. | |
| 5,050,386 | A * | 9/1991 | Krieg | E02D 3/115 165/45 |
| 5,507,149 | A * | 4/1996 | Dash | B09C 1/00 165/45 |
| 5,623,986 | A * | 4/1997 | Wiggs | F24J 3/083 165/163 |
| 5,816,314 | A * | 10/1998 | Wiggs | F24J 3/083 165/134.1 |
| 6,962,466 | B2 * | 11/2005 | Vinegar | B01D 53/002 405/128.4 |
| 2013/0277017 | A1 * | 10/2013 | Mageau | E02D 3/115 165/104.31 |

FOREIGN PATENT DOCUMENTS

| | | |
|---|---|---|
| CN | 201 031 387 Y | 3/2008 |
| DE | 30 36 842 A1 | 5/1982 |
| DE | 10 2004 058457 A1 | 6/2006 |
| DE | 10 2006 007980 B3 | 8/2007 |

* cited by examiner

*Primary Examiner* — Kyle Armstrong
(74) *Attorney, Agent, or Firm* — Philip H. Von Neida

(57) ABSTRACT

A method and a device for freezing the ground are provided with a freeze pipe closed on one front side, and an inner pipe extending into the freeze pipe for supplying a cooling agent, and wherein a hollow body is provided, whose inner diameter is larger than the outer diameter of the freeze pipe.

1 Claim, 6 Drawing Sheets

GROUND FREEZING METHOD

CROSS REFERENCE TO RELATED APPLICATIONS

The present application claims priority from European Patent Application EP15003267.0 filed on Nov. 17, 2015.

BACKGROUND OF THE INVENTION

The invention relates to a ground freezing device with a freeze pipe, which is closed at one front side, and an inner pipe extending into the freeze pipe for supplying a cooling agent. The invention further relates to a method for freezing the ground with a freeze pipe and an inner pipe extending into the freeze pipe, wherein a refrigerant is guided into the freeze pipe via the inner pipe.

In civil and foundation engineering, measures must often be taken to seal or support the ground. During temporary jobs, it makes sense to artificially freeze the ground with liquid nitrogen as the coolant.

When freezing the ground, the cold is introduced via a freeze pipe with a dual pipe system. Liquid nitrogen passes downwardly through an inner pipe and into the freeze pipe, evaporates, and while rising in the annular space imparts its cooling energy to the surrounding soil. Extracting the heat cools and freezes the water in the surrounding soil.

After icing is complete, the freeze pipes as a rule remain in the soil. In some cases, however, this impedes the continued construction process, e.g., since whole section boring machines are unable to pass through the steel or copper pipes used as the freeze pipes. In these instances, it is thus necessary to remove the freeze pipes from the soil after icing.

However, pulling the freeze pipes proves problematical for several reasons. After icing is complete, the surrounding soil is still frozen for weeks. The tensile force that can be applied to the freeze pipes is limited by the material, and pulling the freeze pipe also generates a vacuum on its lower side, which exerts a force on the freeze pipe that counteracts the pulling.

Therefore, the object of the present invention is to indicate a ground freezing device and a corresponding method, which makes it easier to remove freeze pipes from the ground.

SUMMARY OF THE INVENTION

This object is achieved by a ground freezing device with a freeze pipe, wherein the freeze pipe is closed at one front side, and which exhibits an inner pipe extending into the freeze pipe for supplying a cooling agent, and which is characterized in that a hollow body is provided, whose inner diameter is greater than the outer diameter of the freeze pipe.

The ground freezing method according to the invention with a freeze pipe and an inner pipe extending into the freeze pipe, wherein a cooling agent is guided into the freeze pipe via the inner pipe, is characterized in that a hollow body, whose inner diameter is greater than the outer diameter of the freeze pipe, is introduced into the ground, and the freeze pipe is introduced into the hollow body.

According to the invention, removing the freeze pipe from the soil is facilitated by providing a hollow body around the freeze pipe. As a consequence, the freeze pipe does not come into direct contact with the ground, and thus does not become frozen directly to the ground.

In particular, the term hollow body is intended to encompass oblong, hollow bodies, such as a pipe or a hose. The hollow body can be made out of a flexible or inflexible material. As a rule, the hollow body exhibits a circular cross section. However, it can also exhibit a rectangular, oval or other cross section.

After the freeze pipe has been removed, the hollow body remains in the ground. Therefore, it is advantageous to fabricate the hollow body in such a way that the latter does not damage the soil working machine when coming into contact with the latter. For example, this can be accomplished by giving the hollow body a correspondingly thin design, and having the wall thickness of the hollow body measure at most 6 mm, preferably 1 to 2 mm.

Alternatively or also additionally, the hollow body can be fabricated out of a polymer or plastic material, which does not offer the kind of resistance to a soil working machine that would damage said machine.

The hollow body is preferably at least partially or even completely made out of a polymer material. A polytetrafluoroethylene (PTFE) has here proven effective. The advantage to polytetrafluoroethylene (PTFE) is that it has a very low coefficient of friction, so that the low friction between the freeze pipe and cladding tube makes it easier to pull out the freeze pipe.

However, it is also possible to use other polymer materials or plastic materials, for example perfluoroalkoxy copolymers, polyethylene, polyamide, polyoxymethylene, ethylene/vinyl acetate, polyether imide or melamine/phenol resin or other phenol resins, including epoxide resins. In particular, use can also be made of composites that contain polymer materials. The hollow body can also be fabricated out of two or more materials situated one over and/or next to the other. For example, a hollow body consisting of a first plastic or metal can be joined with a second plastic.

Using the hollow body according to the invention prevents the freeze pipe from coming into direct contact with the surrounding ground with its cylinder or shell surface, making it easier to remove it from the ground. Extracting or pulling the freeze pipe is further facilitated by virtue of the fact that the hollow body is sealed at one of its front sides in a preferred embodiment, specifically on the front side that is introduced into the ground. This also prevents the front surface of the freeze pipe from freezing to the ground.

In another embodiment, a contact medium is located between the freeze pipe and hollow body. The contact medium can be used to increase the thermal conduction from the freeze pipe through the hollow body to the surrounding ground. If necessary, the contact medium can also compensate for varying thermal expansion coefficients, and hence for a varying longitudinal contraction of the freeze pipe and hollow body while the freeze pipe cools. Finally, the freeze pipe and/or hollow body can also exhibit production-related tolerances, so that the thermal conduction contact between the freeze pipe and hollow body is not optimal at all locations. This can also be improved with the contact medium. The contact medium is advantageously selected in such a way as to achieve one or more of the aforementioned advantages.

Advantageously used as the contact medium is a material having a freezing point of less than 0° C. or at most 0° C. At temperatures exceeding 0° C., the contact medium is liquid or gaseous.

While cooling the freeze pipes, which preferably takes place with liquid nitrogen or an aqueous saline solution (brine), the contact medium is of course also cooled. Depending on cooling intensity and the freezing point of the contact medium, the contact medium can also pass over into the solid phase. In turn, this can mean that the freeze pipe will become frozen to the hollow body.

Therefore, it has proven favorable to provide means for heating the contact medium. Before removing the freeze pipe from the hollow body as planned, the contact medium is heated, specifically to the point where it passes over into the liquid or gaseous state. The freeze pipe is then enveloped by a liquid or gaseous substance, and can be relatively easily pulled out of the hollow body.

As already stated above, a contact medium with a freezing point of under 0° C. is preferably selected. As a result, the contact medium passes over into the liquid state earlier than the water frozen into ice in the surrounding ground. The ground can be left in a frozen state, while the contact medium is already liquid.

Any type of liquid or gas can be used as the contact medium. Preference is given to substances with a low freezing point and in a harmless water polluting class. Examples for such contact media include aqueous alcohol solutions with ethanol and propanol, or aqueous saline solutions such as sodium chloride, calcium chloride or magnesium chloride.

For example, the contact medium is heated with an electric heater. To this end, an electric heater, for example an electric heating wire, a heating coil, a heating strip or heating sleeve, is provided so as to heat the contact medium as current flows through the heater. For example, a heating wire can be wound around the freeze pipe before introducing the freeze pipe into the hollow body. For example, the heating wire is spirally wrapped around the freeze pipe. It has also proven favorable to place the heating wire or heating element in general axially along the freeze pipe. Several heating elements connected in series or parallel can here also be provided.

The electric heater can also be placed or otherwise introduced into the gap between the freeze pipe and hollow body even after the freeze pipe has been introduced into the hollow body, but before supplying the contact medium. Finally, depending on the contact medium selected, it can also be possible to secure the electric heater only after the contact medium has been introduced. As a rule, however, the heater is provided before cooling the freeze pipe and freezing the ground. The freeze pipe itself can also be used as a resistance heater in place of a heating wire. In this case, a current source is connected directly to the freeze pipe, so that a current flows through the freeze pipe, thereby heating the latter.

Other than or additionally to an electric heater, a heat carrier line can also be provided to supply a heat carrier. To this end, a heat carrier line, for example a hose or pipe, is provided so as to at least sectionally run through the gap between the freeze pipe and hollow body. The heat carrier line can be introduced from above into the gap or also through a hole or similar opening in the jacket or front surface of the hollow body. In the latter case, a portion of the heat carrier line would run outside of the hollow body through the ground. Space conditions permitting, it is also possible to provide the heat carrier line entirely or partially inside of the freeze pipe.

In order to heat the contact medium, a gas or liquid with a temperature exceeding the freezing point of the contact medium is supplied as the heat carrier via the heat carrier line. The temperature of the heat carrier preferably measures between −30° C. and +450° C., in particular when using a gaseous heat carrier. If the heat carrier is a liquid, its temperature preferably measures between 0° C. and 150° C., especially preferably between 50° C. and 150° C. The heat carrier comes into thermal contact with the contact medium, and heats the contact medium at least to a point where it passes over into the liquid aggregate state.

The means for heating the contact medium, for example an electric heater or heat transfer line, are preferably at least partially wound around the freeze pipe. The means for heating the contact medium are here preferably arranged helically around the freeze pipe or even in one or more axial pathways along the freeze pipe. The freeze pipe is subsequently pushed into the hollow body along with the means for heating the contact medium.

In another embodiment, the heat carrier line has a predetermined breaking point and/or outlet openings for the heat carrier. A portion of the heat carrier can then exit through the outlet openings, and come into direct contact with the contact medium. The heat transfer to the contact medium can be further intensified in this way. Alternatively or additionally, the heat carrier line can exhibit a predetermined breaking point that ruptures when exposed to a specific pressure (e.g., 4 bar). Rupturing the predetermined breaking point allows the warm or hot heat carrier to exit, and circulate around the freeze pipe and/or hollow body, thereby accelerating the process of melting the contact medium. In addition, more hoses or pipes can be secured over half the length, for example, enabling the discharge of already cooled heat carrier, and hence increasing the circulation over the entire length of the freeze pipe. The freeze pipe can be pulled out when the contact medium is again liquid.

The cooling medium, for example liquid nitrogen, is supplied into the freeze pipe via the inner pipe. While the freeze pipe and ground cool, the liquid nitrogen heats up and evaporates. The resultant nitrogen gas can be extracted toward the top via the annular gap between the inner pipe and freeze pipe. However, an additional exhaust pipe can also be provided in the freeze pipe, through which the gaseous nitrogen can escape or be extracted. The advantage to the exhaust pipe is that defined flow conditions can be established in the freeze pipe, and that the gaseous nitrogen does not flow through the freeze pipe over its entire length, but is rather extracted at a defined, prescribed height, specifically the height of the inlet opening of the exhaust pipe. For example, the uppermost portion of the ground can in this way be cooled less intensively, or depending on the configuration not be frozen at all. Of course, the above statements also apply to cooling agents other than nitrogen.

The invention makes it possible to easily remove, i.e., pull out, the freeze pipe. As a result, the ground can initially be frozen by means of the freeze pipe. The freeze pipes are then removed, and only the cladding tubes remain in the ground.

BRIEF DESCRIPTION OF THE DRAWINGS

The invention along with additional details of the invention will be explained in more detail below based on exemplary embodiments schematically depicted on the drawings. Shown on.

In all figures, the same elements are provided with the same reference numbers.

DETAILED DESCRIPTION OF THE INVENTION

Figure 1:
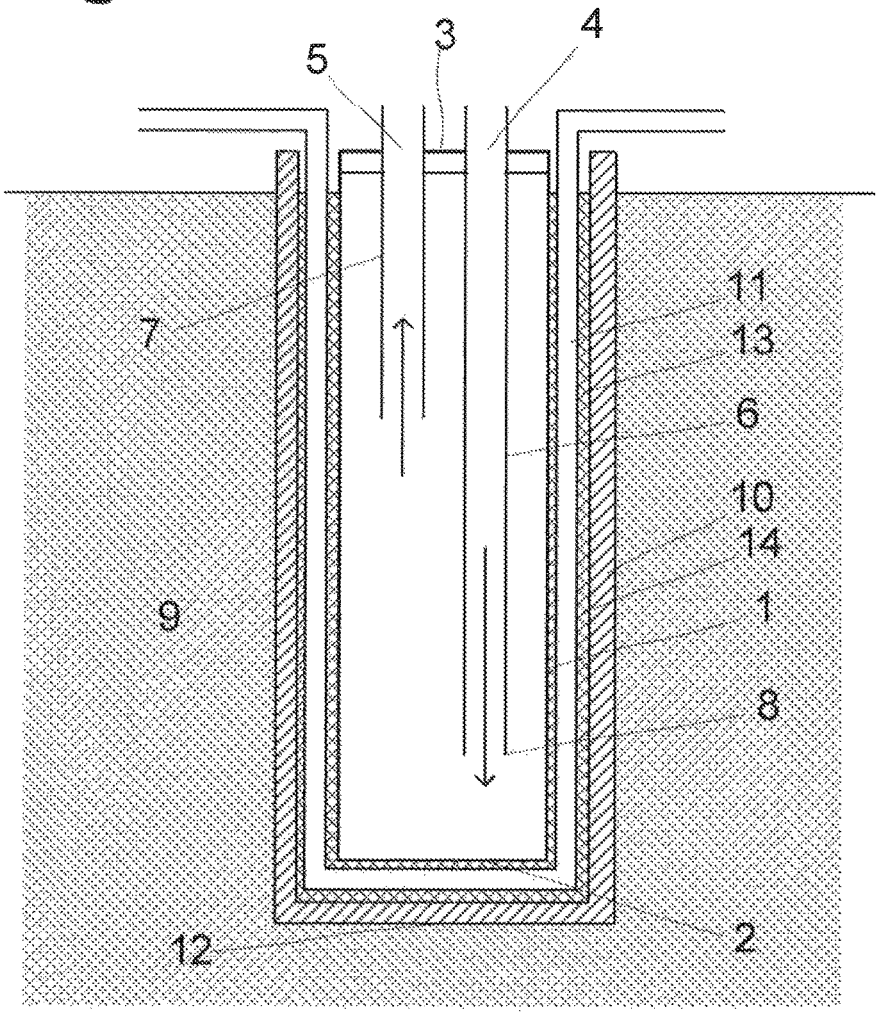
FIG. 1 is a first embodiment of a ground freezing device according to the invention.

FIG. 1 schematically depicts a first embodiment of the invention. A freeze pipe 1 made out of a readily heat conducting material, in particular out of copper, has a diameter of 50 to 100 mm, for example. For example, the length of the freeze pipe measures 1 to 50 m, often 10 m to 30 m.

The freeze pipe 1 is closed on its lower front side 2. The upper front surface 3 is also closed, but exhibits two passages 4, 5 for an inner pipe 6 and an exhaust pipe 7. The inner pipe 6 is open at the lower end 8. A nitrogen tank is connected to the inner pipe 6 by a supply line not shown on the drawing.

A borehole is drilled into the ground 9 to be iced, into which a hollow body 10 is introduced. The hollow body 10 consists of a polytetrafluoroethylene, and has a wall thickness of 0.5 to 6 mm. The hollow body 10 is designed as a cladding tube, and closed at its lower, front end 12.

A heat carrier line 11 is then placed in the hollow body 10. The heat transfer line 11 can be designed either as a hose or as a flexible or inflexible pipe. The heat carrier line 11 is situated in such a way as to be located as close as possible to the hollow body 10, thereby leaving enough space for the freeze pipe. The heat carrier line 11 runs both along the jacket of the hollow body 10 as well as along its floor or front surface 12. The heat carrier line is connected to a feeder for a warm or hot fluid, in particular air or an aqueous saline solution.

The freeze pipe is then pushed into the hollow body 10, so that the heat carrier line 11 comes to lie in the gap 13 between the freeze pipe 1 and hollow body 10.

The gap 13 is finally filled with a liquid contact medium 14, for example with an aqueous saline solution or water.

In order to ice the ground 9, liquid nitrogen is supplied via the inner pipe 6, and guided into the interior of the freeze pipe 1. The liquid nitrogen cools the ground 9 via the surrounding contact medium 14. The nitrogen evaporates in the process. The evaporated, cold gaseous nitrogen, which is also referred to as exhaust, extracts additional heat from the ground. A solenoid valve (not shown) is controlled via the temperature of the exhaust. This ensures a constant flow of nitrogen at an optimal efficiency.

After some time, a frozen region forms around the freeze pipe 1. Once icing is complete, it is in some instances advantageous to remove the freeze pipes 1 from the ground, since the latter may impede subsequent construction progress. For example, whole section boring machines may not be able to pass through the steel or copper pipes used as the freeze pipes 1.

According to the invention, the freeze pipes 1 are pulled out of the ground 9 or out of the hollow body 10 in such a case. To this end, a gaseous heat carrier is first guided through the heat carrier line 11. If the freeze pipe cooled beforehand with liquid nitrogen, a heat carrier with a temperature exemplarily ranging between −50° C. and 0° C. can initially also be used. For example, evaporated gaseous nitrogen can be taken directly out of a nitrogen tank in this phase. As a rule, however, use is made of a heat carrier with a higher temperature, for example of 50° C. to 200° C., e.g., heated air or heated nitrogen gas, so as to more quickly melt and heat the contact medium.

The heat carrier flows through the heat carrier line 11, and in the process heats the surrounding contact medium 14. If the contact medium 14 was in a solid aggregate state, it is again liquefied. Otherwise, at least the viscosity of the contact medium 14 is decreased by heating, so that the contact medium 14 becomes more flowable, and the freeze pipe 1 can be moved more easily in the contact medium 14.

If the contact medium 14 is liquid or has reached a specific flowability, the freeze pipe 1 is pulled out of the hollow body 10 with a pulling device not shown on the drawing.

Figure 2:
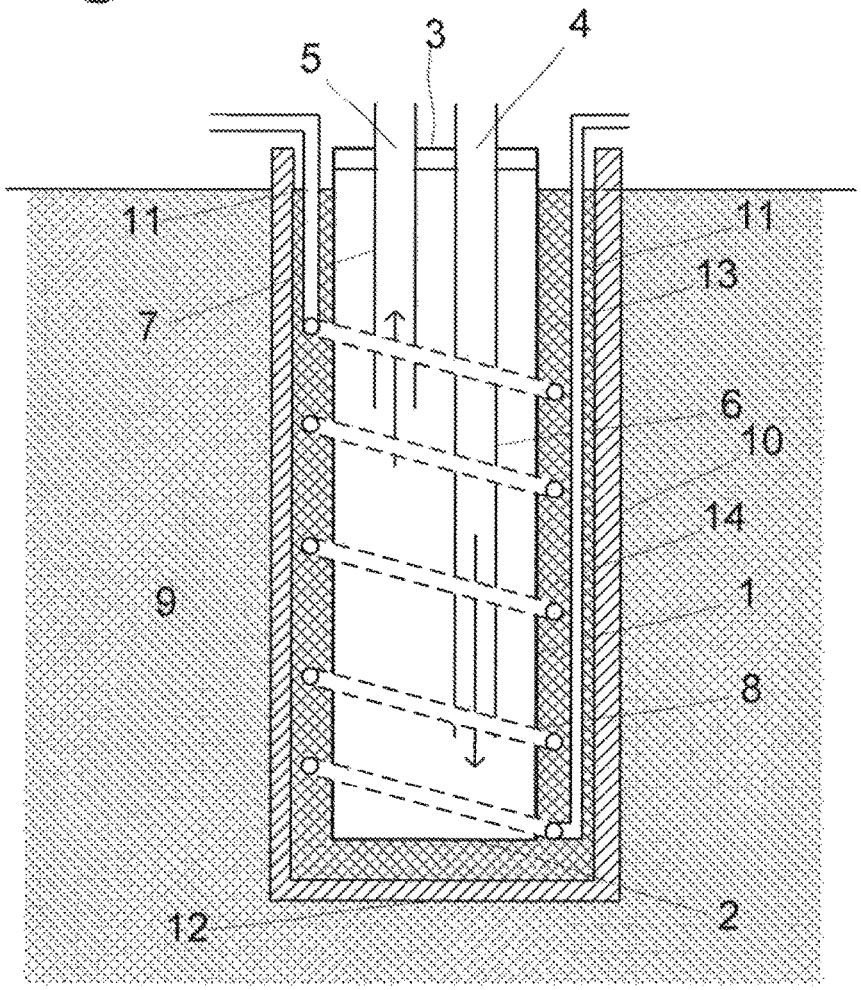
FIG. 2 is a second embodiment.

FIG. 2 shows an alternative embodiment of the invention. This embodiment differs from the one on FIG. 1 in that the heat carrier line 11 is wound around the freeze pipe 1. The heat carrier line 11 is helically wrapped around the freeze pipe 1. On the one hand, the advantage to this is that the freeze pipe 1 together with the heat carrier line 11 can be easily pushed into the hollow body 10. On the other hand, winding the heat carrier line 11 around the freeze pipe 1 results in a uniform heating of the contact medium 14.

Figure 3:
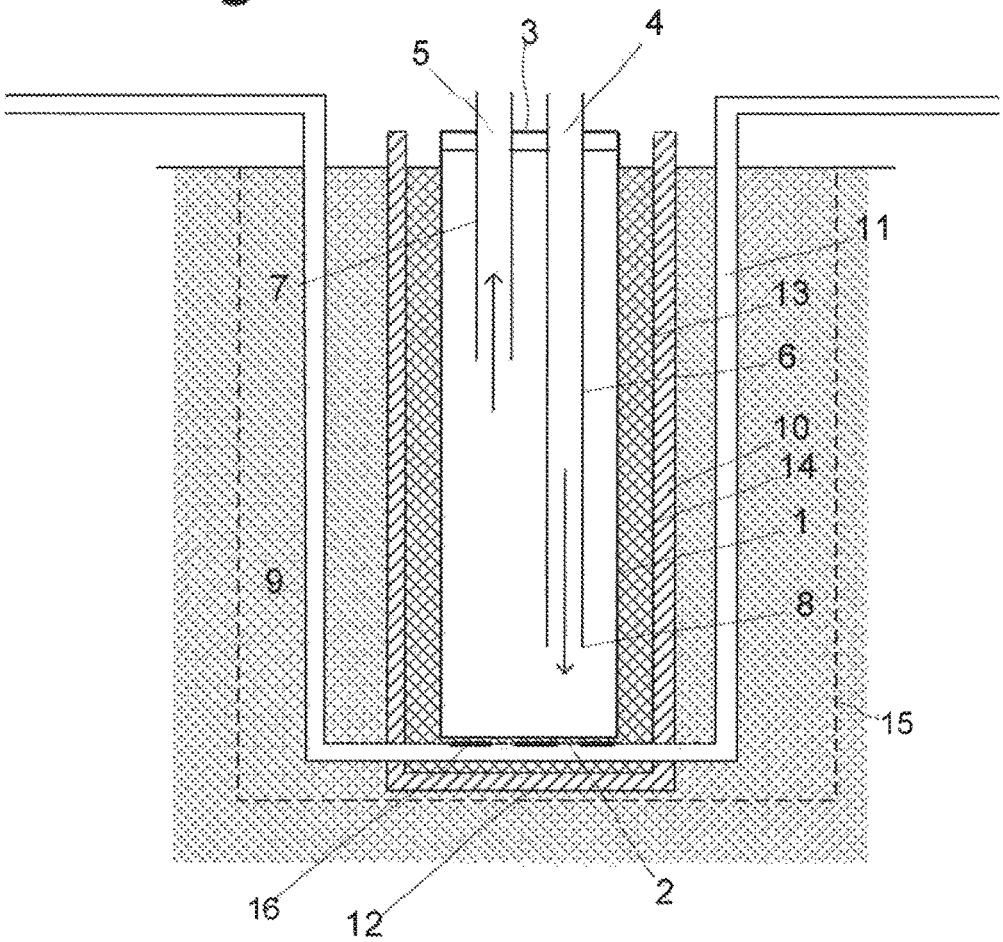
FIG. 3 is a third embodiment.

FIG. 3 shows an embodiment of the invention in which the heat carrier line 11 runs partially through the ground 9. A borehole 15 having a larger diameter than the hollow body 10 is here first drilled. The heat carrier line 11 is guided through the wall of the hollow body 10, runs along the lower front surface 12 of the hollow body, and is taken out again on the opposite side of the hollow body 10.

The hollow body 10 is introduced into the borehole 15 along with heat carrier line 11. As described above, the freeze pipe 1 and contact medium 14 are then placed in the hollow body 1. The heat carrier line 11 is guided toward the top outside of the hollow body 10, and the remaining borehole 15 is again filled with soil or aqueous or pasty building materials, for example cement suspension, bentonite or insulating material. The heat carrier line 11 can further be provided with a predetermined breaking point 16 in the section where it runs inside of the hollow body 10. The predetermined breaking point 16 is designed in such a way as to rupture when a specific pressure has been exceeded, for example 3 bar, and releases an opening. The heat carrier then flows through this opening into the interior of the hollow body 10, and thereby accelerates the melting and heating of the contact medium 14.

Figure 4:
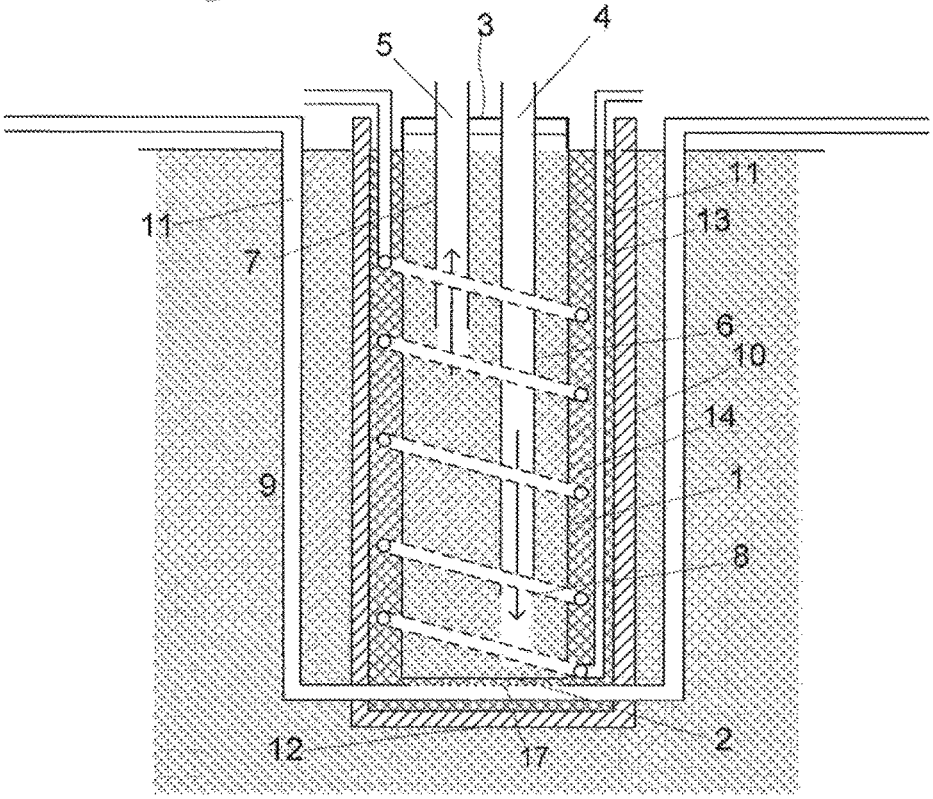
FIG. 4 is a fourth embodiment.

The embodiment according to FIG. 4 is essentially a combination of FIGS. 2 and 3. However, several holes or perforations 17 are provided in place of the predetermined breaking point 16 in the section of the heat carrier line 11 that runs inside of the hollow body 10. For example, the holes or perforations 17 have a diameter of between 0.05 mm and 0.4 mm, for example 0.15 mm or 0.2 mm, so that a portion of the heat carrier can flow through these holes 17 into the interior of the hollow body 10.

Figure 5:
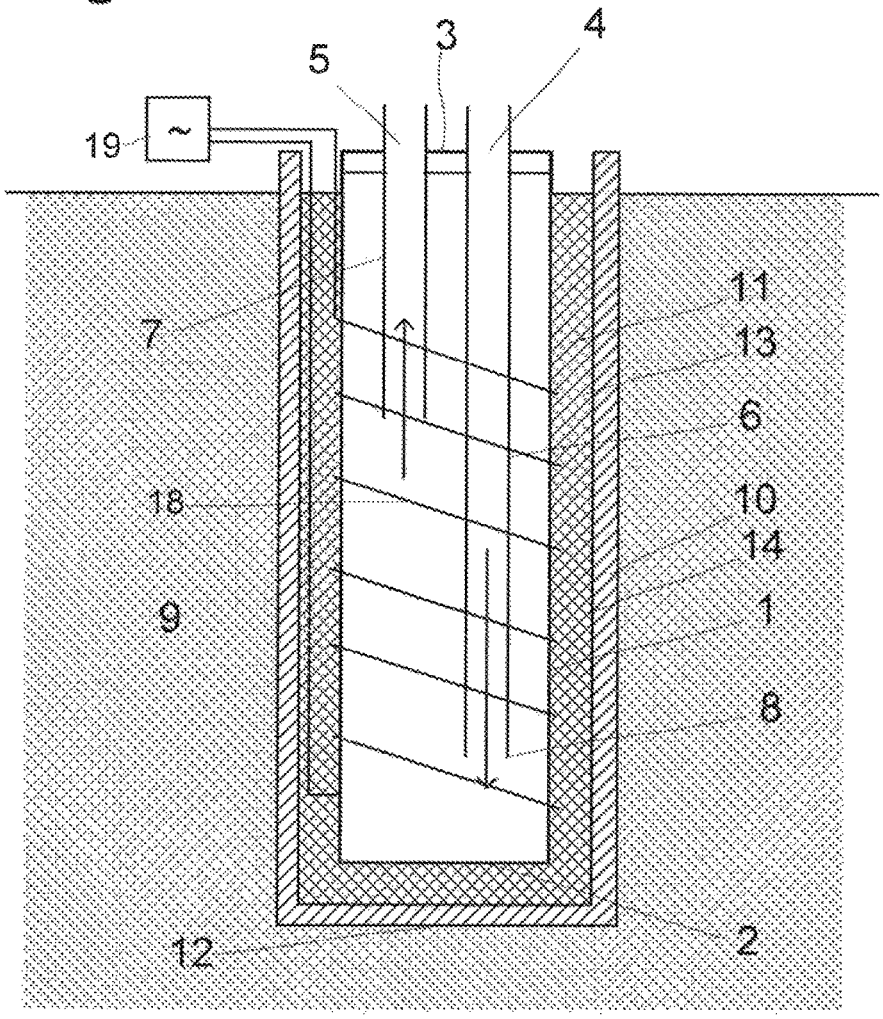
FIG. 5 is a fifth embodiment.

In the variant according to FIG. 5, an electric heater 18 is provided to heat the contact medium 14 instead of a heat carrier line. A heating wire 18 is helically wrapped around the freeze pipe 1, and pushed into the hollow body 10 with the freeze pipe 1. The gap 13 between the freeze pipe 1 and hollow body 10 is filled with the contact medium 14. As described above, the freeze pipe 1 is then cooled with liquid nitrogen, and the surrounding soil is frozen. In order to thaw and heat the contact medium 14, the heating wire 18 is hooked up to a current source 19, and a heating current is passed through the heating wire 18.

The electric heater shown on FIG. 5 can be used not just as an alternative to a heat carrier line, but also in addition thereto. In the latter case, the heating of the contact medium

14 is significantly accelerated via heat transfer from the heat carrier and the electric heater.

Figure 6:
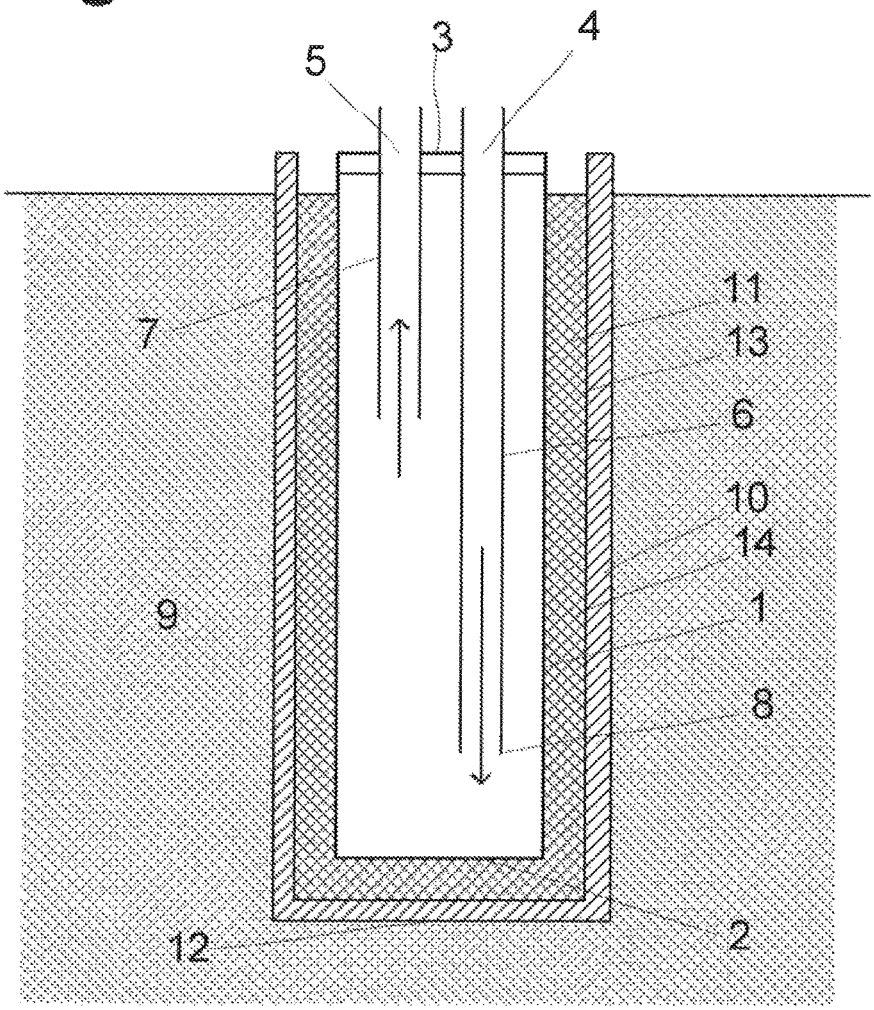
FIG. 6 is a sixth embodiment of the invention.

Finally, FIG. 6 reveals another variant of the invention. In this case, the contact medium 14 is heated by supplying a heat carrier into the freeze pipe 1. To this end, a heat carrier, in particular a warm gas, for example gaseous nitrogen with a temperature of 50 to 450° C., is guided into the freeze pipe 1. The contact medium 14 is in direct contact with the exterior of the freeze pipe 1, and is heated by the heat carrier. For example, the heat carrier can be supplied via the inner pipe 6 and withdrawn again via the exhaust pipe 7, thereby generating a circulation of heat carrier. The heat carrier circulation can be further improved by opening the upper front surface 3 of the freeze pipe 1.

Of course, heating the contact medium 14 via the freeze pipe 1 as described based on FIG. 6 can also take place in addition to the methods described on FIGS. 1 to 5. The contact medium 14 can be heated with one or more of the following methods:

Heating with a heat carrier introduced into the freeze pipe

Heating with a heat carrier that flows through a heat carrier line in heat exchanging contact with the contact medium Heating with a heat carrier, which is directly guided into the contact medium, and/or Heating with an electric heater.

What we claim is:

1. A ground freezing method comprising using a freeze pipe and an inner pipe extending into the freeze pipe, wherein a cooling agent selected from the group consisting of liquid nitrogen and aqueous saline solution is guided into the freeze pipe via the inner pipe, wherein a hollow body comprising a polymer material having a wall thickness less than 6 millimeters with an inner diameter larger than the outer diameter of the freeze pipe is introduced into the ground, and the freeze pipe is introduced into the hollow body, wherein a contact medium having a freeze point of at most 0° C. is introduced into a op between the hollow body and the freeze pipe and the freeze pipe and/or the contact medium are heated by an electric heater before removing the freeze pipe and the freeze pipe is removed from the hollow body after the ground has been frozen.

* * * * *